US006015367A

United States Patent [19]

Scaramucci

[11] Patent Number: 6,015,367

[45] Date of Patent: Jan. 18, 2000

[54] DEVICE FOR AUTOMATICALLY SELECTING AND HOOKING WEIGHTS OF PHYSICAL EXERCISING APPARATUSES

[75] Inventor: Mauro Scaramucci, Ascoli Piceno, Italy

[73] Assignee: Newform S.p.A., Ascoli Piceno, Italy

[21] Appl. No.: 08/996,235

[22] Filed: Dec. 22, 1997

[30] Foreign Application Priority Data

Dec. 20, 1996 [IT] Italy ..... RM96A0888

[51] Int. Cl.[7] ..... A63B 21/06

[52] U.S. Cl. ..... 482/5; 482/94; 482/98

[58] Field of Search ..... 482/5, 94, 98–103

[56] References Cited

U.S. PATENT DOCUMENTS

| | | | |
|---|---|---|---|
| 4,546,971 | 10/1985 | Raasoch | 482/98 |
| 4,746,113 | 5/1988 | Kissel | 482/5 |
| 5,037,089 | 8/1991 | Spagnuolo et al. . | |
| 5,256,122 | 10/1993 | Deden . | |
| 5,350,344 | 9/1994 | Kissel . | |
| 5,643,151 | 7/1997 | Naimo | 482/98 |

FOREIGN PATENT DOCUMENTS

| | | | |
|---|---|---|---|
| 2613237 | 10/1966 | France | 482/99 |
| 33 32 150 | 3/1985 | Germany . | |

*Primary Examiner*—John Mulcahy
*Attorney, Agent, or Firm*—Smith, Gambrell & Russell, LLP

[57] ABSTRACT

The invention concerns a device for automatically selecting and hooking weights of a physical exercising apparatus, the apparatus providing a single frame, a plurality of individual weights to be selected and engaged and a dragging element for the selected and hooked or engaged weight. The device provides at least one element for selecting and hooking the chosen weight and optionally weights upward of the chosen one. An activation system is provided to actuate at least one element for selecting and hooking the chosen weight. An electronic circuit for controlling the activation system and a system to set and control the selection and the hooking of the selected weight.

13 Claims, 12 Drawing Sheets

4
2
P1
25
P2
P3
Pn-1
Pn 4
3
25
2
P1
P2
P3
Pn-1
Pn

DEVICE FOR AUTOMATICALLY SELECTING AND HOOKING WEIGHTS OF PHYSICAL EXERCISING APPARATUSES

FIELD OF THE INVENTION

The present invention relates a device for automatically selecting and hooking weights of physical exercising apparatuses.

More particularly, the invention concerns a device of the above kind allowing to automatically select weights of a physical exercising apparatus before beginning the work, without the need of interrupting the exercising to be able to modify the charge to achieve the desired weight program.

BACKGROUND OF THE INVENTION

As it is well known, in conventional physical exercise apparatuses involving the possibility of changing the charge or changing the number of weights dragged during the action of the person performing the physical exercising, either for strengthening or for therapeutic purposes, the weights selection (i.e. the choice of the kind and the number of elements to be lifted) occurs by the positioning of a metallic element (fork or pin) on the dragging element (carriage pin), which drags the established weights thanks to the work of the user.

It is also known that anytime the above operation is carried out it is done manually by the user, who, therefore, must manually intervene on the weight selection system whenever there is a desire to change the charge between one series and another.

Really, in order to vary the amount of physical effort, the user must be in a rest position and must physically modify the position of the fork or pin. At first, the fork must be removed from the original position, then it must be inserted in the new position corresponding to the new selection.

This operation is clearly not convenient for the user who must interrupt the exercising, provide the correct position for the execution of the exercising and, then only after having positioned again the fork, start again working.

Obviously, when using this conventional technique, it is not possible to provide for a change in the charge during the execution of a series of repetitions, but only between two following series.

Furthermore, there is not provided in any way the realisation of a physical exercising apparatus wherein an automatic managing of the charges depending on the specific needs of the user is provided.

SUMMARY OF THE INVENTION

In view of the above, the Applicant has realised a device directed at being able to solve all the mentioned drawbacks. That is, a device that allows for the automatic selection and hooking of weights on the basis of previously set out instructions without the need that the user must intervene during the execution of the series of exercises with the apparatus.

These and other results are obtained according to the present invention by the realisation of a device of the above kind that substantially provides hooking means for ferrous material weights, controlled by a suitable electronic circuit.

It is therefore a specific object of the present invention to provide a device for automatically selecting and hooking weights of physical exercising apparatuses, the apparatus providing a fixed frame, plurality of single weights to be selected and hooked and a dragging element for the selected and hooked weights, said device being characterised in that it provides means for selecting and hooking having at least an element for selecting and hooking the chosen weight and thus also any weights upward of the chosen one, means to activate said at least one element for selecting and hooking the chosen weight, an electronic circuit for controlling said activation means, and means to set and control said selection and said hooking of the established weight.

Preferably, according to a first embodiment of the device according to the invention, said means for selecting and hooking is comprised of an electromagnetic element for each weight, centrally placed in said selected and hooked dragging element, and of at least a pin, preferably two, movable between a hooking position and a releasing position. With the motion of said at least one pin between the hooking position and the realising position acting to modify the value of the current to the electromagnetic element corresponding to the weight to be hooked.

According to the invention, said at least one pin can be provided integral to the corresponding electromagnetic element, in this case the motion of said at least one pin between the hooking position and the releasing position acting to modify the polarisation of the electromagnetic element, or integral to the corresponding weight, wherein the motion of said at least one pin between the hooking position and the releasing position acting to magnetise or not the electromagnetic element.

Still according to the invention, two electromagnetic elements for each weight can be provided, provided in suitable seats obtained in a central position on said pins and each carrying a pin, movable between a hooking position with the selected weight dragging element, and a releasing position, the motion of said pin between the hooking position and the releasing position acting to modify the polarisation of the electromagnetic element corresponding to the weight to be hooked.

According to the invention, all the weights upward of the last selected weight or only the selected weight dragging all the upward weights can be hooked.

In a further embodiment of the device according to the invention, said means for selecting and hooking comprises a motion system that is integral with said dragging element, providing movable means for the selection and the hooking of the selected weight.

Particularly, according to the invention, said motion system can be of the electromagnetic, pneumatic or hydraulic kind.

Preferably, said system can be provided with a motor, two reduction gears, laterally provided with respect to the weights to be hooked, a transmission member between the two reduction gears, two worm screws coupled with said two reduction gears and extending laterally with respect to said weights, and along which a selection and hooking element of said selecting and hooking or engaging means slides while being supported on a movable support thereof.

According to the invention, the selection and hooking elements of said selecting and hooking means can be comprised of two electromagnetic elements slidable along said worm screws on said movable supports, and moved into position with respect to corresponding pins, provided into suitable seats in each of said weights, movable between a hooking position and a releasing position, the motion of said pins between the hooking position and the releasing position acting to modify the current value fed to the electromagnetic element brought in correspondence of the weight to be hooked.

Furthermore, according to the invention, the selection and hooking elements of said selecting and hooking means can be comprised of two mechanical actuators, carried along said worm screws by said movable supports, interacting with pins provided on each of said pins, hooking the pins of the selected weight.

Furthermore, according to the invention, said selection and hooking elements of said movable means can be comprised of two deflection elements, carried along said worm screws by said movable supports and provided with a coupling roll, interacting with the links of a chain integral with said hooked weight dragging element, coupling the chain link with teeth laterally provided on said weights, hooking the selected weight according to the height along said worm screw.

Also, according to the invention, said device provides computer means for the managing of the selection and the hooking of various weights according to the specific requirements of the user.

Still according to the invention, said device provides means to allow the user to set a pre-established sequence.

Furthermore according to the invention, said device can provide a data reading and/or writing system on a memory support.

Further embodiments are described making reference to the figures of the drawings and claimed in the dependent claims.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION OF THE PREFERRED EMBODIMENTS

Figure 1:
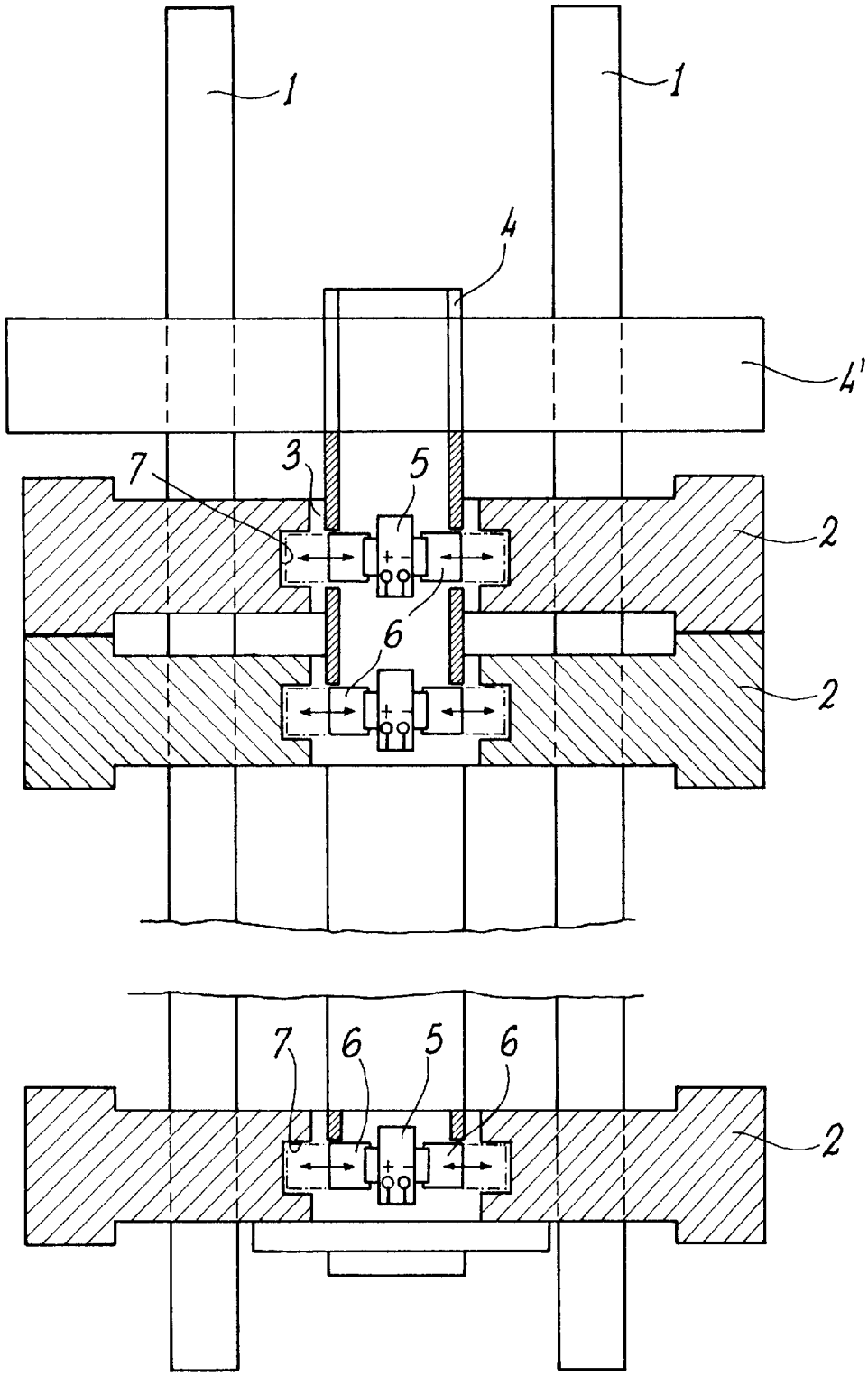
FIG. 1 is a schematic view of a first embodiment of the device according to the invention.

Making at first reference to FIG. 1, a first embodiment of the device according to the invention is shown, for the hooking and selection of weights in a physical exercising apparatus.

Obviously, said apparatus is not shown in any of the enclosed figures, since the device according to the invention can be provided on any apparatus.

In the different figures, the corresponding parts will be indicated by the same reference numbers.

In FIG. 1, two slides are shown, for the sliding of weights, as well as a series of weights 2 to be hooked and selected.

Centrally, weights 2 provide a hole 3 for the insertion on the carriage pin 4, integrally bearing the carriage 4', to which the weights must be selectively hooked in order to be lifted by the user that will act, by means not shown since not included in the present invention, just on the carriage pin 4.

Within the carriage pin 4, in the home position, at a height corresponding to each of the weights 2, electromagnetic elements 5 are provided, in number corresponding to that of the weights 2.

Each one of the electromagnetic elements 5 has a couple of metallic pins 6, movable between two positions, respectively for the connection and the disconnection, and each weight 2 provides seats 7 for said pins 6 when they are in the connection position.

By changing the polarisation of the electromagnetic elements 5, the change of the position of the pins 6 is determined. Then, it will be sufficient to send the polarisation change signal to the electromagnetic element 6 corresponding to the weight 2 to be hooked or engaged to be able to carry out the exercising with the desired charge.

Obviously, a computer, not shown, can manage, by the aid of position sensors, the variation of the weight 2 hooked eventually also after every stroke of the carriage 4, and in any case according to a pre-established sequence, chosen on the basis of the specific needing of the user without the need that the latter must intervene but at the beginning.

It can be provided that all of the pins 6 of the weights 2 upward the last one to be hooked and connected, in order to obtain a distribution of the charge between more pins.

Figure 2:
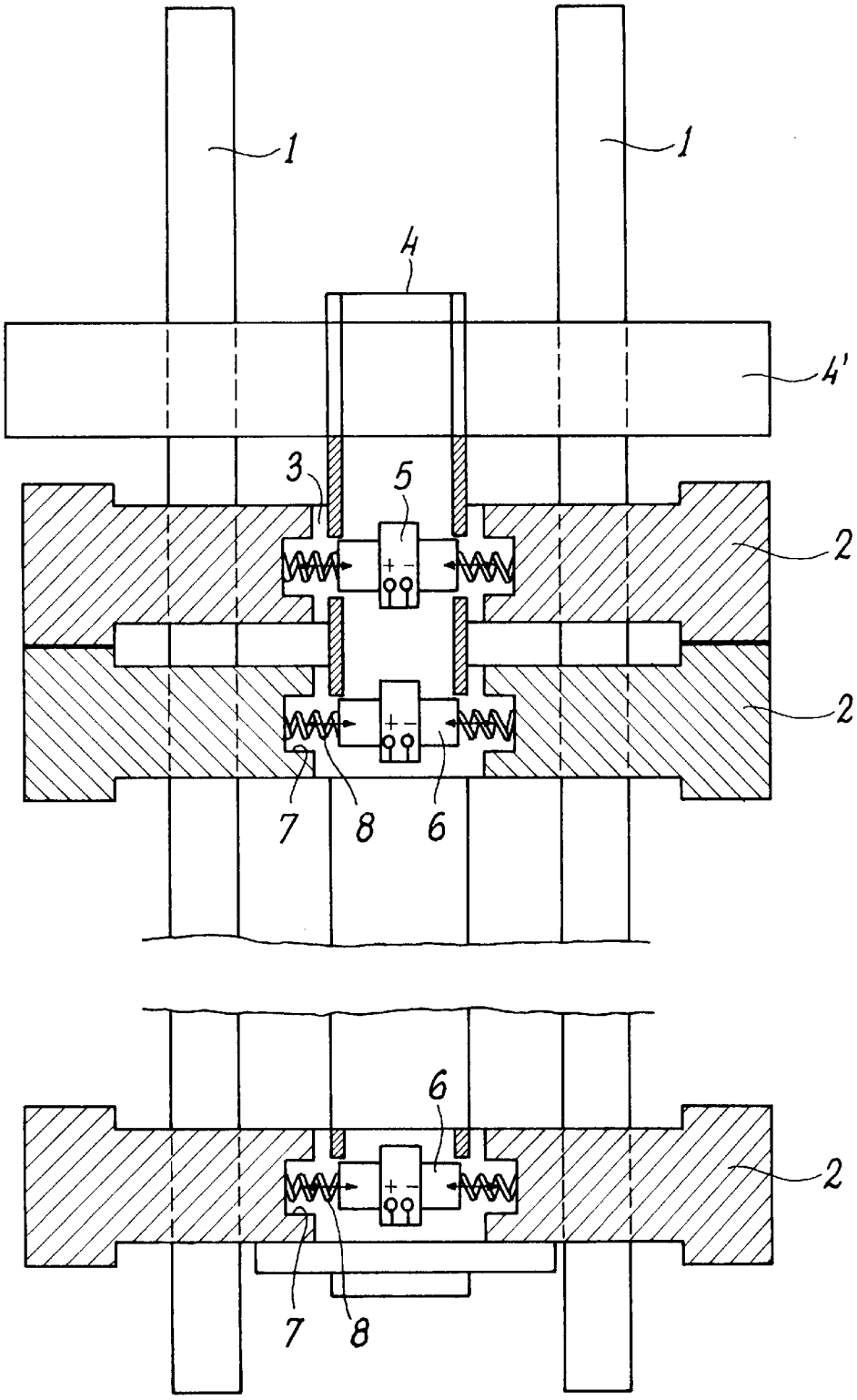
FIG. 2 is a schematic view of a second embodiment of the device according to the invention.

The solution of FIG. 2 is very similar to the one shown and described with reference to the previous figure.

The substantial difference that can be noted in this case consists in the fact that the pins 6 are provided within the seats 7 of the single weights 2, which are physically integral with respect to them.

Between the pins 6 and the respective weights 2, counter springs 8 are provided, acting on the pins 6 to maintain them within the seat 7.

The working and the principle of this embodiment substantially correspond to that already described with reference to FIG. 1, in this case being based on the variation of the current sent to the electromagnetic elements.

Figure 3:
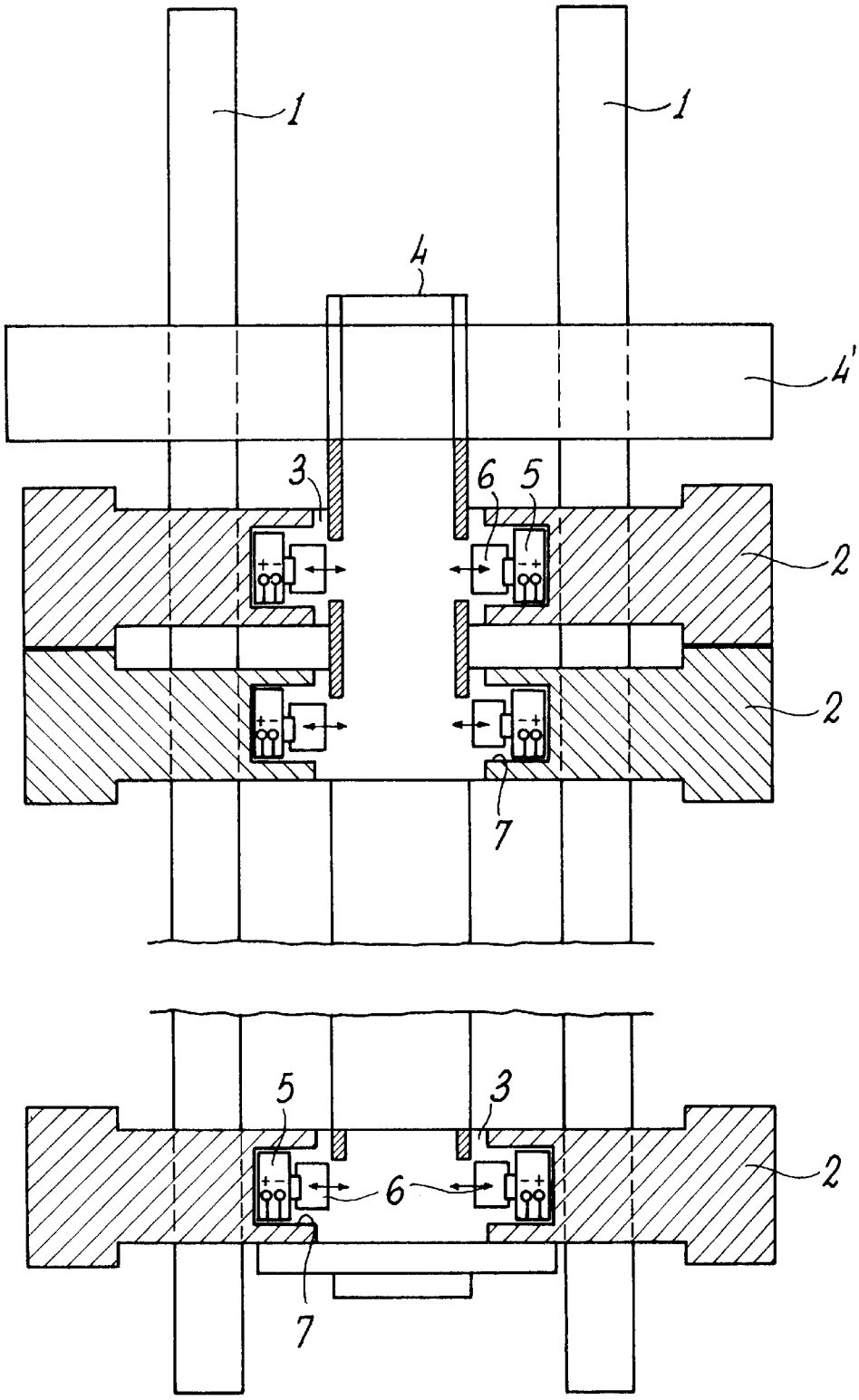
FIG. 3 is a schematic view of a third embodiment of the device according to the invention.

Acting on the basis of the same principle, but with a slightly different disposition of the element, is the solution shown in FIG. 3.

In this case, the electromagnetic elements 5 are housed within the seats 7 of each weight 2, so that the two electromagnetic elements 5 for each weight 2 will be provided, each electromagnetic element being provided with a respective integral pin 6.

Besides the opposite stroke of the pins 6 to pass from a connection position to a disconnection position, and vice versa, the working principle of the device shown in FIG. 3 corresponds to the one of the previous embodiment of FIG. 1.

Figure 4:
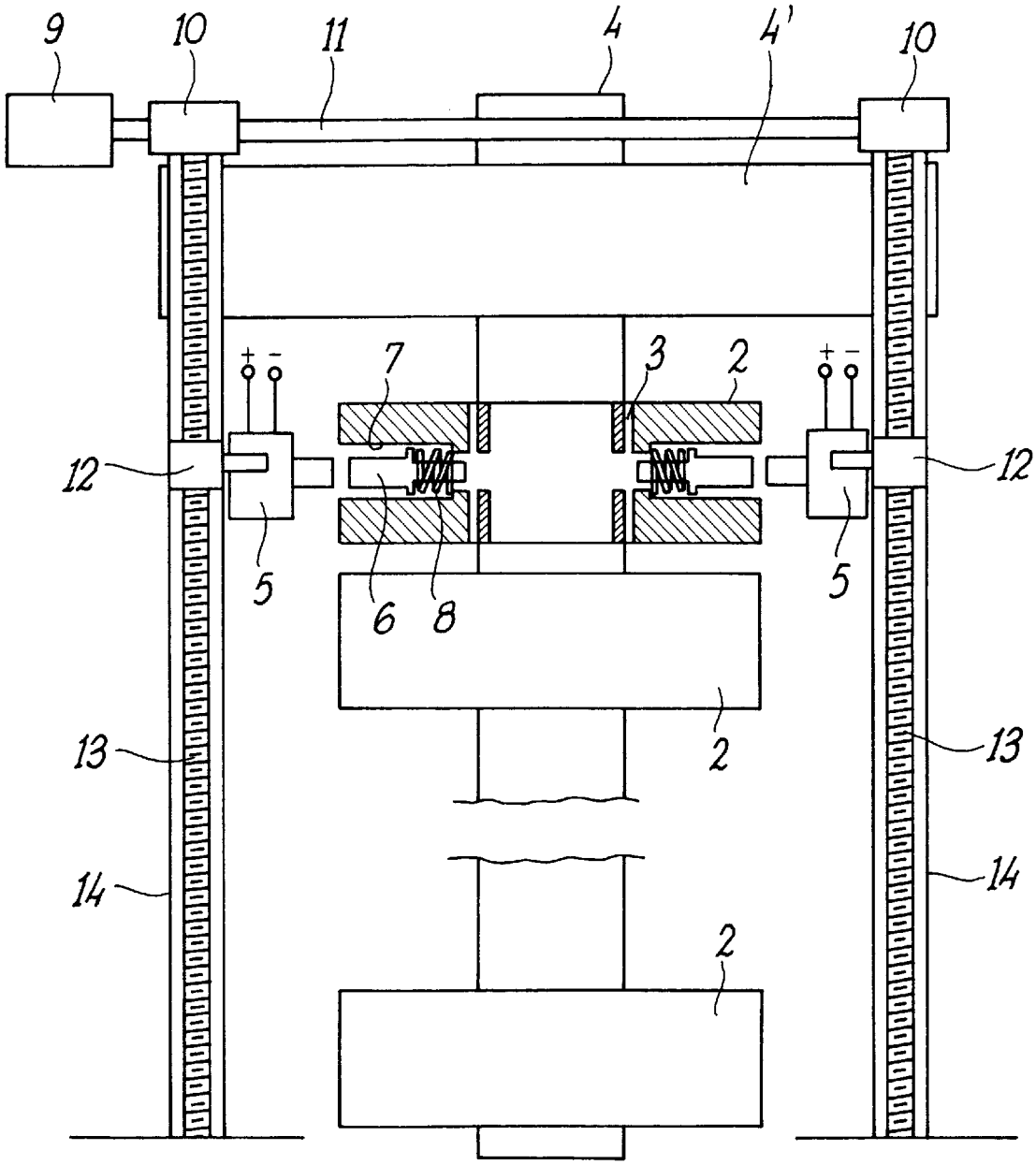
FIG. 4 is a schematic view of a fourth embodiment of the device according to the invention.

Observing now FIG. 4, a fourth embodiment of the device according to the invention is shown, said device providing an electromechanical system, comprised of a motor 9, two reduction gears 10 and a transmission member 11, integral to the carriage 4'.

Two electromagnetic elements 5 are integral to the electromechanical system, being carried by a movable support element 12, slidable along threaded supports 13, rotationally connected to said reduction gears 10.

The reduction gears 10 are mounted on two fixed supports 14, provided aside the weight 2 column.

Within the seats 7 of each weight, pins 6 are provided, each pin having a counter spring 8.

The two electromagnetic elements 5 are positioned by the electromechanical system, and particularly by the action of the motor 9, of the reduction gears 10, of the threaded supports 13 and of the movable supports 12, at the height of the weight to be hooked.

Afterwards, the electromagnetic elements are magnetised to bring the corresponding pins 6 in a connection position, and then to drag the weights upward the chosen weight by the carriage 4'.

In this case, too, a suitable computerisation allows a user, in advance, to program any sequence of work.

Obviously, in this as well as in the following embodiments, the electromechanical system can be replaced by an equivalent system, such as a pneumatic or hydraulic system, without departing from the scope of the invention.

Figure 5:
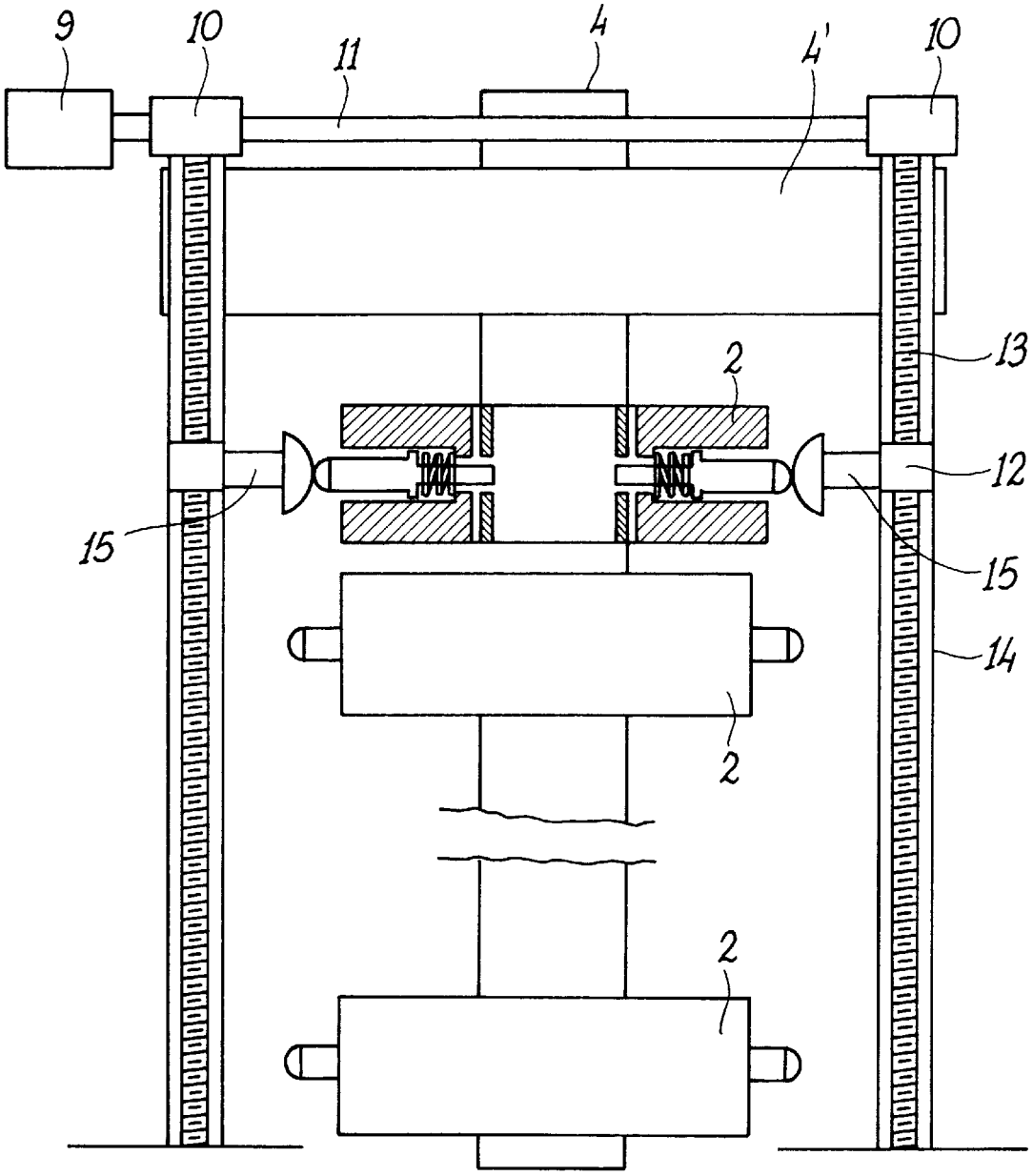
FIG. 5 is a schematic view of a fifth embodiment of the device according to the invention.

In FIG. 5, it is shown a further embodiment of the device according to the invention very similar to the solution shown with reference to FIG. 4.

In this case, instead of the electromagnetic elements, mechanical actuators 15 integral to the movable supports are provided, said actuators acting on the pins 6 provided within the seats 7 of each weight.

The positioning of the mechanical actuators 15 in correspondence of the weight to be hooked causes the interference with the corresponding pins and thus the hooking of the selected weight 2.

However, in this case too the same remarks already set forth for the previous embodiments are valid.

Figure 6:
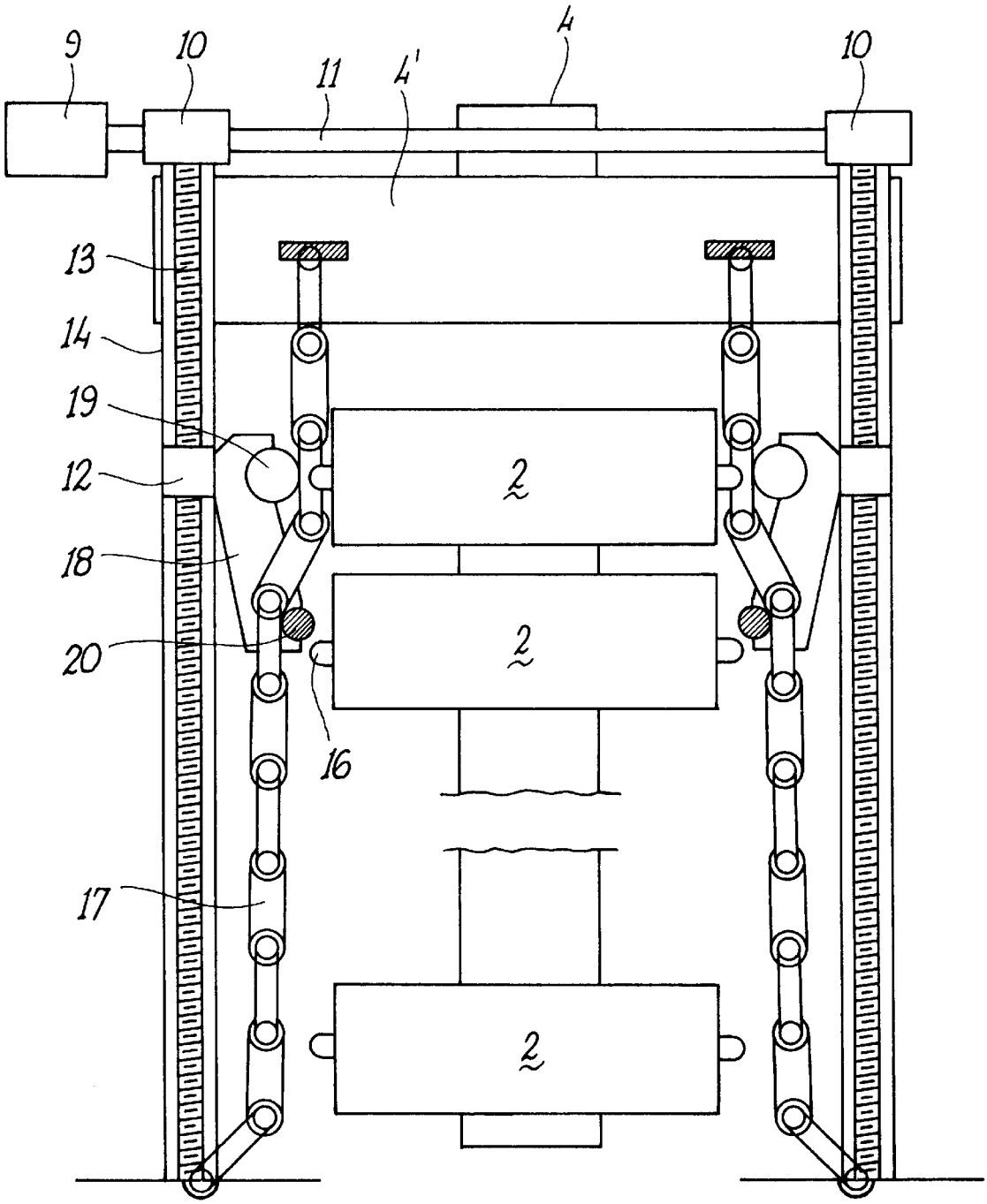
FIG. 6 is a schematic view of a sixth embodiment of the device according to the invention.

Observing now FIG. 6, a sixth embodiment of the device according to the invention is shown, said embodiment providing many of the elements already described with reference to the previous FIGS. 4 and 5.

The hooking of the selected weights 2 is in this case due to the interaction between teeth or engagement elements 16, laterally placed with respect to each weight 2, with the links of a toothed chain 17, integral to the movable carriage 4', and metallic deflection elements 18, integral with said movable supports 12, and provided with an idle roll 19 and a transmission roll 20.

The deflection element is positioned, as in the previous cases, at the height of the weight 2 to be hooked. Said deflection element 18, by way of the idle roll 19, bears the chain 17 link toward the tooth 16 of the chosen weight 2, hooking or engaging the same.

In this case too, by suitable devices and programs, it is possible to obtain the desired hooking sequence for the specific case and the desired function in accordance with the training or therapeutic needs of the user.

Figure 7:
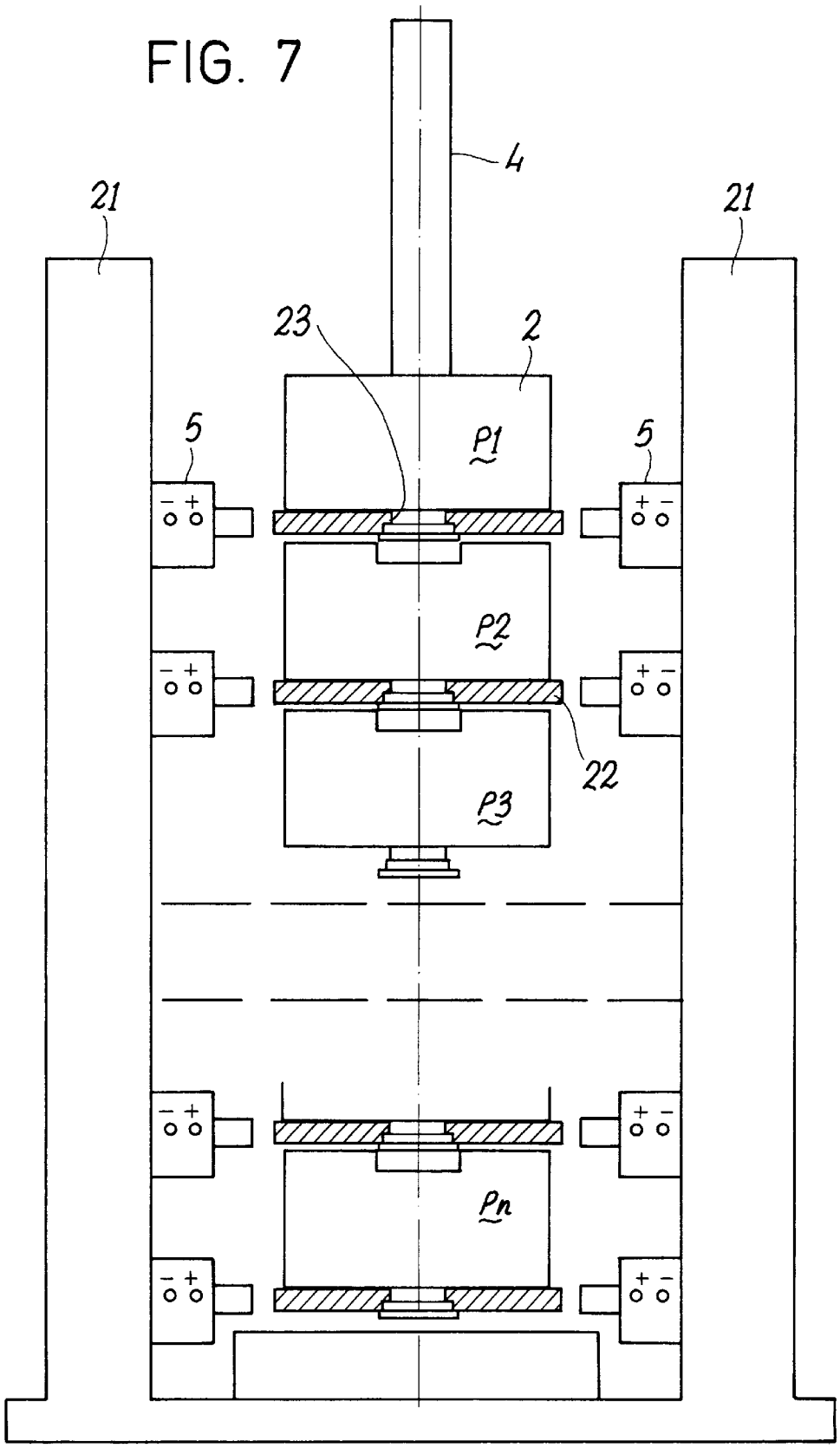
FIG. 7 is a schematic view of a seventh embodiment of the device according to the invention.

In FIG. 7 it is shown a seventh embodiment of the device according to the invention that provides two fixed columns 21, integral with the frame of the apparatus, on both of which electromagnetic elements 5 are arranged, in number corresponding to that of the weights 2 which, at the home position, are hence facing a couple of electromagnetic elements 5.

A metallic plate 22, having a central through hole 23, is provided underneath each weight 2. In particular, said hole 23 is suitably shaped so to provide two possible positions for the plate 22 with respect to the axis of the carriage pin 4; in a first position, e.g. with the plate 22 shifted leftwards in the drawing, the carriage pin 4 may freely run through the hole 23; in a second position, e.g. with the plate 22 shifted rightwards in the drawing, the carriage pin 4 is restrained in the profile of the hole 23 and drags, while running, the plate 22 and, consequently, the corresponding weight 2.

Sending a suitable polarising signal to one electromagnetic element 5 of the couple, e.g. the left one, the corresponding plate 22 is shifted connection the carriage pin 4 in the profile of the corresponding hole 23. Once the plate 22 is shifted to the connection position, it is no more necessary to keep the electromagnetic field generated by the corresponding electromagnetic element 5.

For disconnecting the carriage pin 4, it is necessary to send a polarising signal to the other electromagnetic element 5 of the couple, e.g. the right one, corresponding to the plate 22, causing the motion of the plate 22 to the position wherein the carriage pin 4 freely runs through the hole 23.

It is also possible to send phase opposed polarising signals to both electromagnetic elements 5 of the couple corresponding to the plate 22 to make them co-operating in causing the plate 22 to shift from one position to the other.

Eventually, it is possible to provide that the carriage pin 4 shall be restrained also in all of the plates 22 above the weight 2 to be hooked so as to obtain a weight distribution among a plurality of plates 22.

It is evident for those skilled in the art that the electromagnetic elements 5 arranged on one or both columns 21 may be substituted by corresponding mechanical actuators rotating around the relevant column 21.

It is possible to provide a single electromagnetic element 5 per weight 2, suitably calibrating its power, polarising them in different ways to cause the two different shifts of the plates 22.

Furthermore, it is possible to provide a single electromagnetic element 5 per column 21, eventually on only one column 21, that are integral with an electromechanical system, similar to the one shown in FIG. 4, integral with the frame of the apparatus instead of the carriage 4'. The electromagnetic element 5 of each column 21 is arranged, through the electromechanical system, at the level of the plate 22 to be shifted to cause the carriage pin 4 to be restrained into or unrestrained from the profile of the corresponding hole 23.

Figure 8:
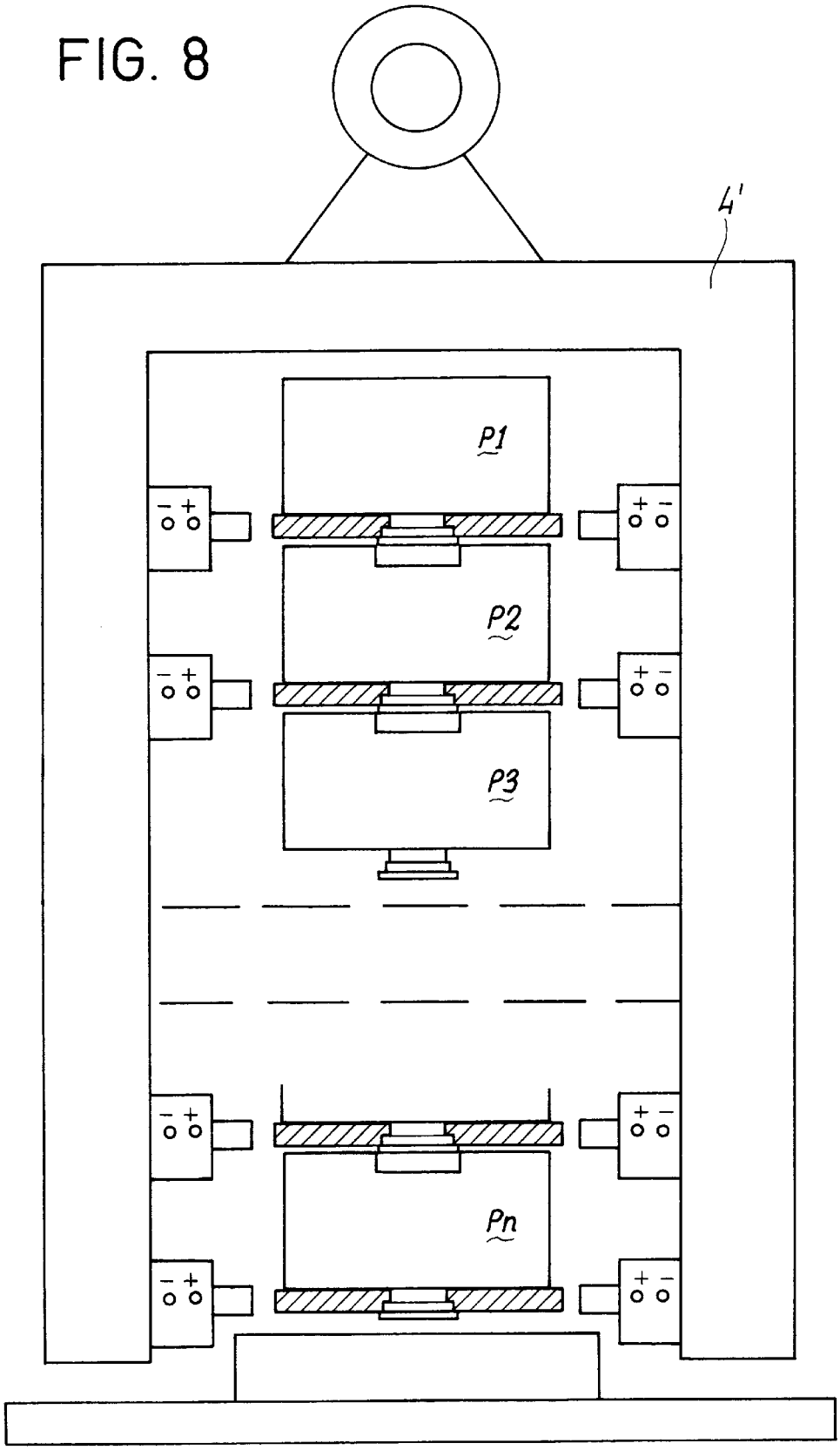
FIG. 8 is a schematic view of a eighth embodiment of the device according to the invention.

The solution shown in FIG. 8 is similar to the one shown and described with reference to the previous figure.

The substantial difference in this case is the fact that the two columns 21 are integral with the carriage 4'.

The operation and the principle of this embodiment correspond substantially to the one already described with reference to FIG. 7, taking into account that in the present case the polarising signal may be kept on for the whole duration of the exercising.

Also in this case, the variations outlined with reference to FIG. 7 are still valid, so as to provide rotating mechanical actuators instead of the electromagnetic elements 5 on one or both columns 21, or to provide a single column of electromagnetic elements 5 or a single electromagnetic element 5 per column, eventually on only one column, integral with an electromechanical system similar to the one in FIG. 4 and integral with the carriage 4'.

Figure 9:
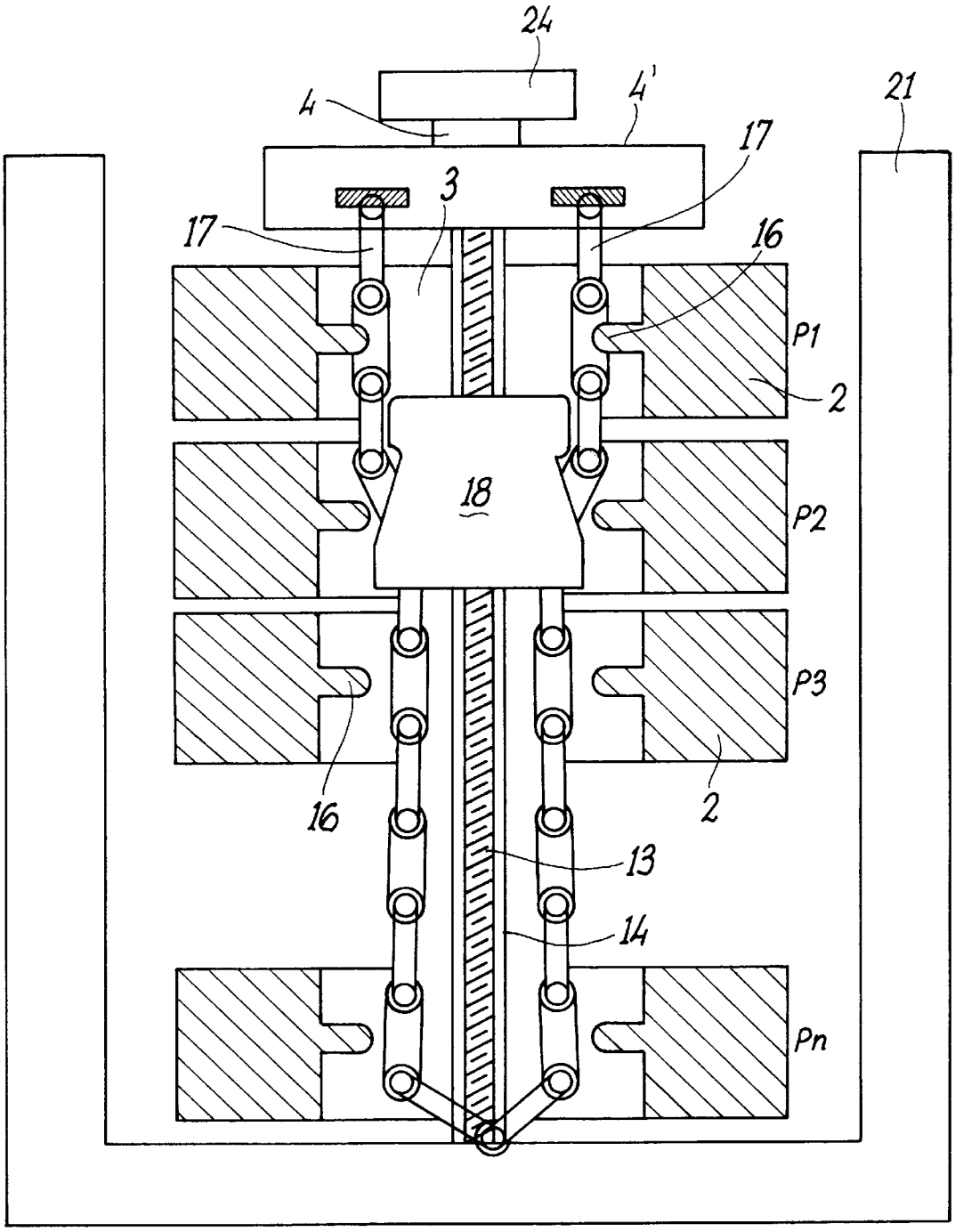
FIG. 9 is a schematic view of a ninth embodiment of the device according to the invention.

In FIG. 9 it is shown a ninth embodiment of the device according to the invention that is similar to the one described with reference to FIG. 6, with the difference that the electromechanical system provides a single fixed support 14 and a single threaded support 13, integral with the carriage 4' and arranged, instead of sideways in respect of the column of weights 2, inside central through holes 3 of said weights 2.

Similarly, the toothed chains 17 are inserted into the holes 3 and interact with corresponding teeth 16 arranged, in the present case, inside the hole 3 of the selected weight 2 under the control of a single deflection element 18 provided with transmission means, as coupling rollers, for the links of the two chains 17.

Said deflection element 18 is movable along the threaded support 13 under the control of an engine and a reduction gear, sketched by the block 24, integral with the carriage 4'.

Figure 10:
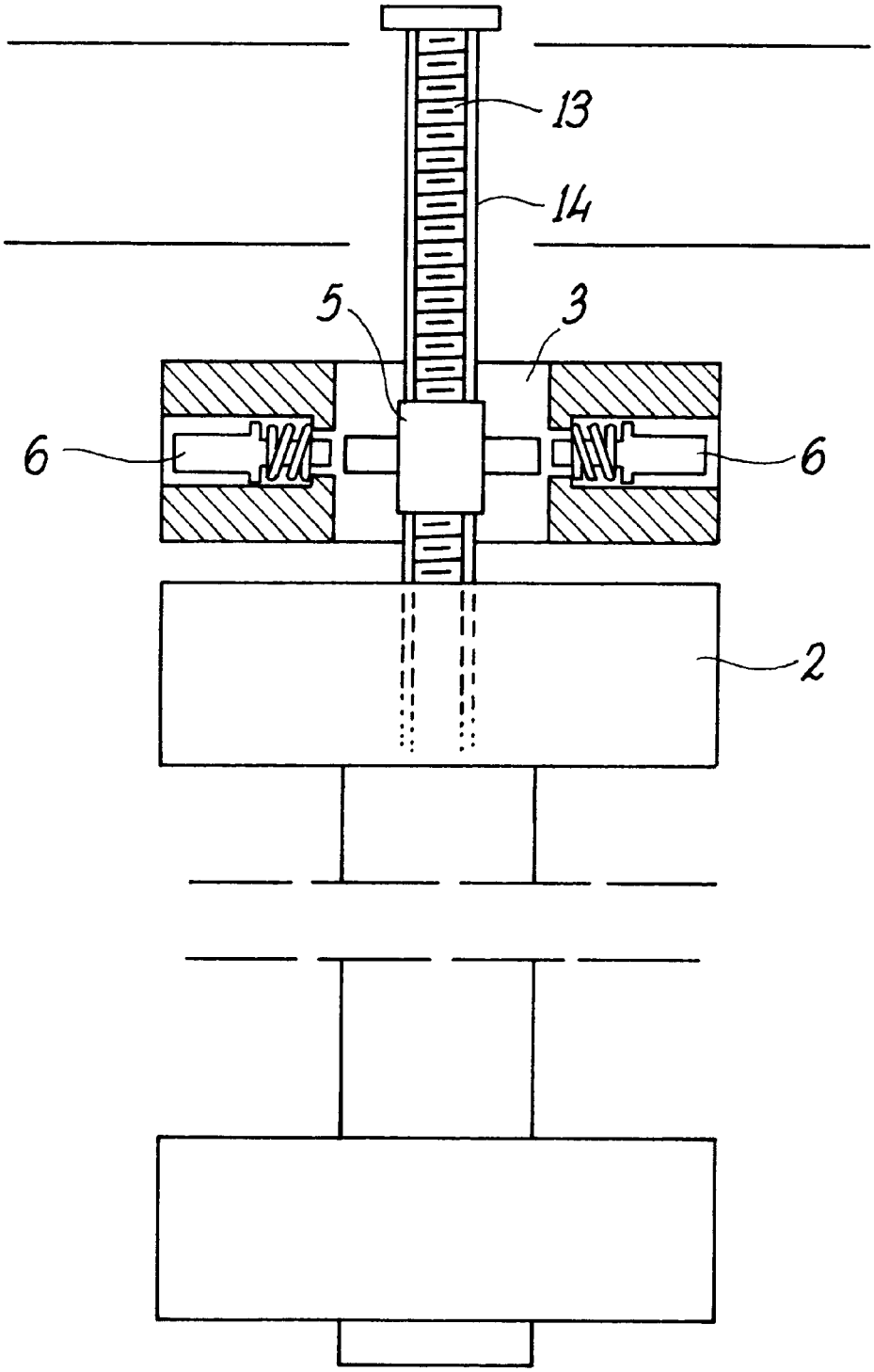
FIG. 10 is a schematic view of a tenth embodiment of the device according to the invention.

The solution in FIG. 10 is similar to the one shown and described with reference to FIG. 4, with the difference that the electromechanical system provides a single fixed support 14 and a single threaded support 13, integral with the carriage (not shown) and arranged, instead of sideways in respect of the column of weights 2, inside central through holes 3 of said weights 2.

A single electromagnetic element 5, provided with two pole pieces, is integral with the electromechanical system and running along the threaded support 13 under the control of an engine and a reduction gear (not shown) integral with the carriage.

Magnetising the electromagnetic element 5, the corresponding pins 6 are set to connection position, dragging with the carriage the weights 2 above the selected one.

Figure 11:
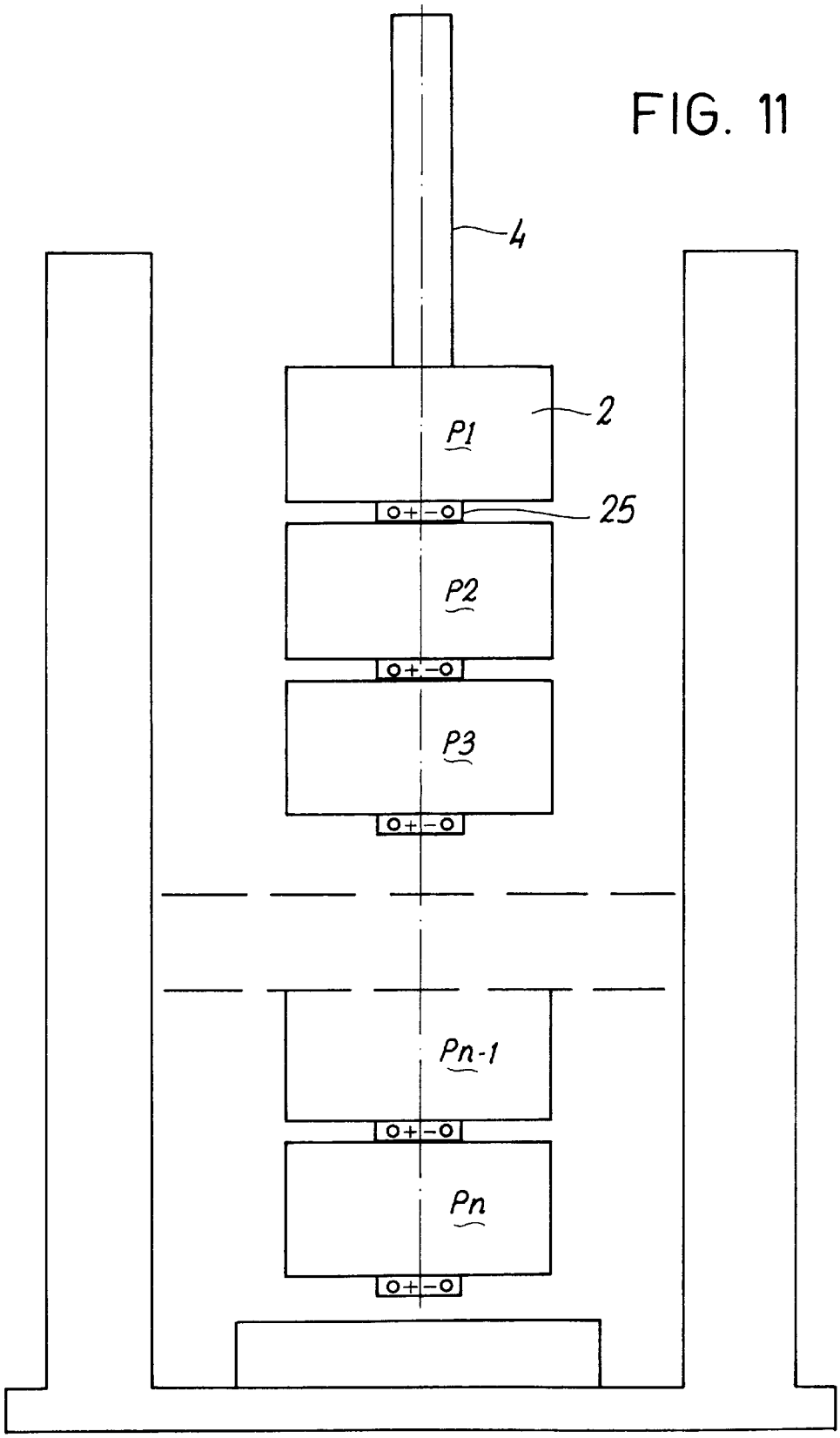
FIG. 11 is a schematic view of an eleventh embodiment of the device according to the invention.

In FIG. 11 it is shown an eleventh embodiment of the device according to the invention that provides that an electromagnet 25 is integrally coupled with the lower face of each weight 2, eventually excluding the weight 2 at the bottom of the weight pack. It is evident that the electromagnets 25 may be inserted in corresponding notches in the lower face of the weights 2.

The weight 2 at the top of the weight stack is integrally coupled with the carriage pin 4.

Each weight 2, eventually excluding the one at the top of the weight stack, has at least one portion of the upper surface made of ferromagnetic material, so as to interact with the electromagnet 25 of the weight 2 just above.

In particular, magnetising all the electromagnets 25 above the selected weight 2, all the upward weights 2, starting from the selected one, become integral with the carriage pin 4 so that the carriage pin 4 drags them along its running.

Figure 12:
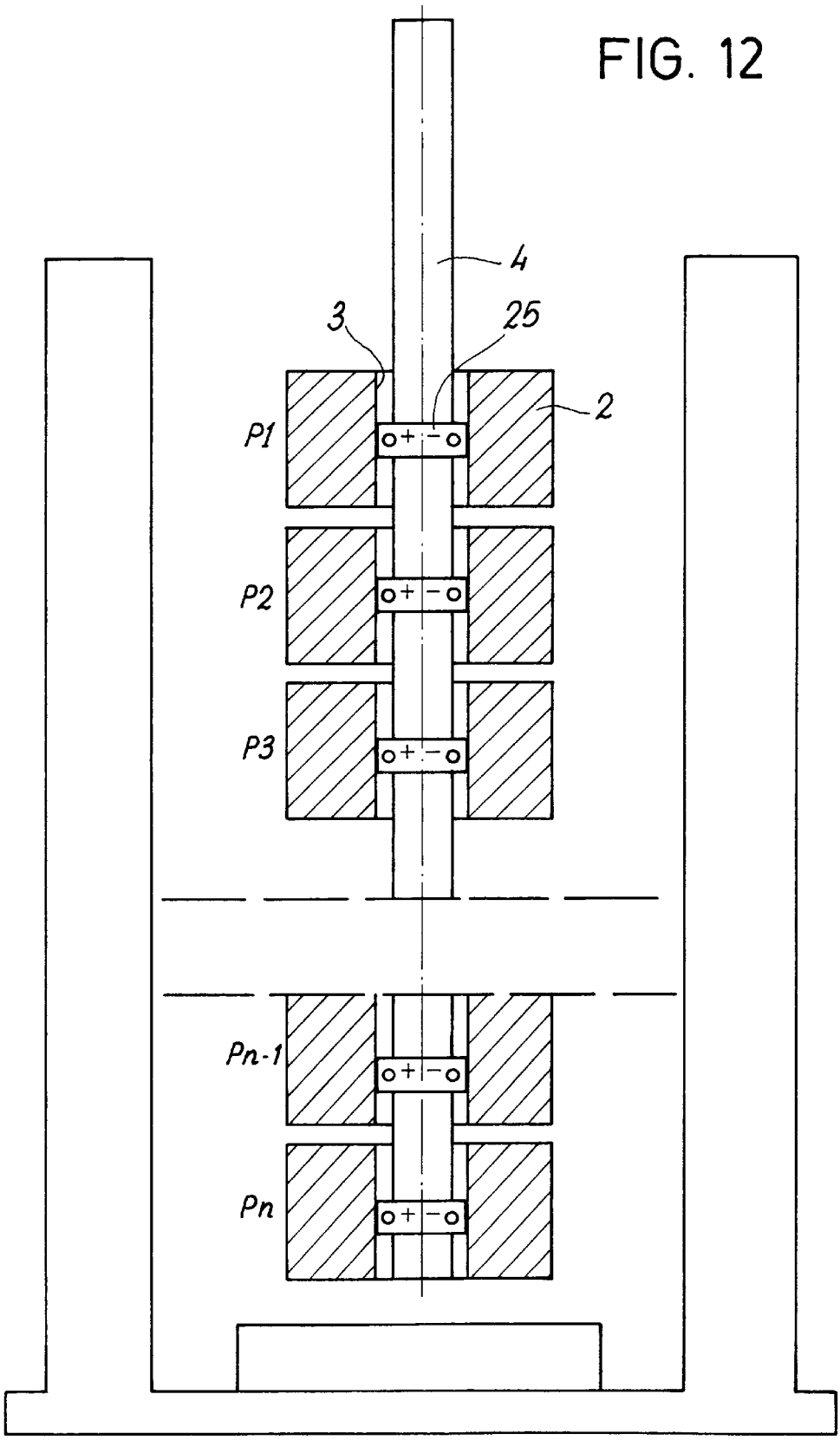
FIG. 12 is a schematic view of a twelfth embodiment of the device according to the invention.

In FIG. 12 it is shown a twelfth embodiment of the device according to the invention that provides that electromagnets 25, in number corresponding to the number of weights 2, are integrally coupled with the carriage pin 4 at such a level that, with the carriage pin 4 at the home position, each electromagnet 25 is inside the central through hole 3 of a corresponding weight 2.

Each weight 2 has at least one portion of the surface of the hole 3 made of ferromagnetic material so as to interact with the corresponding electromagnet 25.

In particular, magnetising the electromagnet 25 corresponding to the selected weight 2, such weight 2 becomes integral with the carriage pin 4 that drags also all the other weights 2 above it along its running.

Eventually, it is possible to provide that also the electromagnets 25 corresponding to the weights 2 above the selected one are magnetised so as to obtain a weight distribution among a plurality of electromagnets 25.

Also in the cases described with reference to the FIGS. 7, 8, 9, 10, 11 and 12, it is possible, through suitable equipment and programs, to obtain the desired hooking sequence for the specific case and depending on the user's training or therapeutic requirements.

The present invention has been described for illustrative but not limitative purposes, according to its preferred embodiments, but it is to be understood that modifications and/or changes can be introduced by those skilled in the art without departing from the relevant scope as defined in the enclosed claims.

I claim:

1. A device for automatically selecting and engaging weights of a physical exercising apparatus, comprising:

a fixed frame;

a plurality of weights to be selected and engaged;

a dragging element for supporting selected and engaged weights to be shifted in position with respect to said fixed frame;

means for selecting and engaging weights to be supported by said dragging element, said means for selecting and engaging weights to be supported by said dragging element including a motion system, said motion system including a motor, at least one reduction gear, a worm screw coupled with said at least one reduction gear, and a selecting and engaging device which is supported on and movable with said worm screw, and said motion system being supported by and movable with said dragging element;

activation means for activating said motion system supported by said dragging element; and electronic control and setting means for setting and controlling said means for selecting and engaging weights so as to have said motion system position said selecting and engaging element into an engagement relationship with respect to a preselected one of the weights to be supported following activation of said activation means;

said selecting and engaging device including an interaction element which is carried along said worm screw and provided with a coupling roll, which is positioned for interacting with links of a chain supported by said dragging element, so as to couple a chain link with a weight engagement member provided on a selected one of said weights.

2. A device for automatically selecting and engaging weights of a physical exercising apparatus, comprising:

a fixed frame;

a plurality of weights to be selected and engaged;

a dragging element for supporting selected and engaged weights to be shifted in position with respect to said fixed frame;

means for selecting and engaging weights to be supported by said dragging element, said means for selecting and engaging weights to be supported by said dragging element including a motion system, said motion system including a motor, at least one reduction gear, a worm screw coupled with said at least one reduction gear, and a selecting and engaging device which is supported on and movable with said worm screw, and said motion system being supported by and movable with said dragging element;

activation means for activating said motion system supported by said dragging element; and electronic control and setting means for setting and controlling said means for selecting and engaging weights so as to have said motion system position said selecting and engaging element into an engagement relationship with respect to a preselected one of the weights to be supported following activation of said activation means;

said selecting and engaging device riding along a central axis of said worm gear which central axis is fixed in a common position with respect to said weights both when said selecting and engaging device is in motion along said screw axis and when said selecting and engaging device assumes an engagement relationship position with the selected one of said weights.

3. A device for automatically selecting and engaging weights of a physical exercising apparatus, comprising:

a fixed frame;

a plurality of weights to be selected and engaged;

a dragging element for supporting selected and engaged weights to be shifted in position with respect to said fixed frame;

means for selecting and engaging weights to be supported by said dragging element, said means for selecting and engaging weights to be supported by said dragging element including a motion system, said motion system including a motor, at least one reduction gear, a worm screw coupled with said at least one reduction gear, and a selecting and engaging device which is supported on and movable with said worm screw, and said motion system being supported by and movable with said dragging element; and activation means for activating said motion system supported by said dragging element; and electronic control and setting means for setting and controlling said means for selecting and engaging weights so as to have said motion system position said selecting and engaging element into an engagement relationship with respect to a preselected one of the weights to be supported following activation of said activation means;

said selecting and engaging device including a chain path deviation member drivingly coupled to said worm screw and a chain in contact with said chain path deviation member so as to position at least one link of said chain into engagement with a selected one of said weights.

4. A device as recited in claim 3 wherein said chain path deviation member includes a pair of chain contact rollers.

5. A device for automatically selecting and engaging weights of a physical exercising apparatus, comprising:

a fixed frame;

a plurality of weights to be selected and engaged;

a dragging element for supporting selected and engaged weights to be shifted in position with respect to said fixed frame;

means for selecting and engaging weights to be supported by said dragging element, said means for selecting and engaging weights to be supported by said dragging element including a motion system, said motion system including a motor, at least one reduction gear, a worm screw coupled with said at least one reduction gear, and a selecting and engaging device which is supported on and movable with said worm screw, and said motion system being supported by and movable with said dragging element;

activation means for activating said motion system supported by said dragging element; and electronic control and setting means for setting and controlling said means for selecting and engaging weights so as to have said motion system position said selecting and engaging element into an engagement relationship with respect to a preselected one of the weights to be supported following activation of said activation means;

said dragging element supporting a single worm screw and said selecting and engaging device includes a chain path deviation member and a pair of chains connected at one end to the dragging element with each chain feeding into a respective reception area on opposite sides of said chain path deviation member, and said chain path deviation member traveling along said worm screw and within a passageway formed by aligned recesses provided in said weights.

6. A device for selecting and engaging weights of a physical exercise apparatus, comprising;

a fixed frame;

a plurality of weights to be selected and engaged;

a dragger element for supporting selected and engaged weights;

a movement support member supported by said dragger;

a selection and engagement device which is supported by and movable with said dragger element and which includes a selecting and engaging element movably coupled to said movement support member, said selecting and engaging element being movable and position fixable along said movement support, and said selection and engagement device further comprising a chain formed of a plurality of links which is placed in contact with said selecting and engaging element to deviate a path of said chain so as to position at least one chain link in engagement with a corresponding weight engagement member while leaving chain links free of engaging contact with other of said weights.

7. A device as recited in claim 6 wherein said selecting and engaging element includes a deflecting roller which comes in contact with said chain.

8. A device as recited in claim 6 and further comprising a motor wherein said movement support member includes a worm screw and said motor being in driving communication with said worm screw, and said selecting and engaging element includes a worm screw coupling coupled with said worm screw.

9. A device as recited in claim 8 wherein said motor is supported on said dragger element.

10. A device as recited in claim 6 further comprising means for presetting and controlling movement of said selecting and engaging element along said worm screw to position said selecting and engaging element in an engagement relationship with respect to a pre-selected weight.

11. A device as recited in claim 6 wherein said selecting and engaging element and said movement support member extend within a pathway defined by a set of common aligned holes formed in said weights.

12. A device as recited in claim 6 wherein a pair of movement support members extend along opposite ends of a stack of said weights and a first chain and a second chain are positioned between respective ends of said weights and an adjacent one of said movement support members, and a pair of selecting and engaging elements are provided with each including a first portion movably coupled with a respective one of said movement support members and another portion in deflecting contact with a respective one of said chains.

13. A device as recited in claim 6 where said movable support member is a worm screw and said dragger device supports a first and a second chain, and said chains and movable support member extend within an aligned series of holes in a stack of said weights and said selecting and engaging element rides along said worm screw and includes a first side receiving and deflecting a first of said chains and a second side receiving and deflecting a second of said chains.

* * * * *